US006488532B2

(12) United States Patent
Balzano

(10) Patent No.: US 6,488,532 B2
(45) Date of Patent: Dec. 3, 2002

(54) CHARGER-TO-BATTERY CONNECTOR

(76) Inventor: Alfiero Balzano, 11371 Monarch St., Garden Grove, CA (US) 92841

( * ) Notice: Subject to any disclaimer, the term of this patent is extended or adjusted under 35 U.S.C. 154(b) by 0 days.

(21) Appl. No.: 09/947,492

(22) Filed: Sep. 5, 2001

(65) Prior Publication Data

US 2002/0025717 A1 Feb. 28, 2002

Related U.S. Application Data

(60) Provisional application No. 60/228,482, filed on Aug. 29, 2000.

(51) Int. Cl.[7] ..... H01R 11/00
(52) U.S. Cl. ..... 439/504; 439/500
(58) Field of Search ..... 439/504, 491, 439/503, 500, 510, 759; 320/2, 54, 25

(56) References Cited

U.S. PATENT DOCUMENTS 4,239,322 A * 12/1980 Gordon, Jr. ..... 439/500
4,829,223 A * 5/1989 Broberg et al. ..... 320/2
5,462,453 A * 10/1995 Muller ..... 439/510
5,575,682 A * 11/1996 Alexander ..... 439/500

* cited by examiner

*Primary Examiner*—Renee Luebke
*Assistant Examiner*—Phuongchi T Nguyen
(74) *Attorney, Agent, or Firm*—Roger A. Marrs

(57) ABSTRACT

A flex cabling having a socket connector at one end and a pair of terminal caps at the other end. The flex cabling is plastic or the like into which at least one run of flat conductor material or wire is embedded extending from a pair of polarized terminals in the socket connector to the respective terminal caps. The flex cabling provides a one-piece unitary construction and the terminal caps are insertably receive the respective terminals on the battery. The terminals of the socket connector are marked with positive and negative indicia so that a mismatch of polarity from a plug of a battery charger cannot be misaligned. Misalignment is further avoided by providing a keyway in the cabling socket connector so that the connectors of the plug from the charger can only be inserted into the terminal openings of the socket connector in proper orientation. A panel is pivotally or slidably carried adjacent to the terminal openings so that the terminal openings may be covered to prevent dirt, debris, or any foreign matter from entering into the socket.

1 Claim, 1 Drawing Sheet

CHARGER-TO-BATTERY CONNECTOR

This application claims Priority based on Ser. No. 60-228,482 filed Aug. 29, 2000.

BACKGROUND OF THE INVENTION

1. Field of the Invention

The present invention relates to the field of electrical plug and socket connectors, and more particularly to a novel connector for use between a battery charger and a battery wherein the socket connector is connected to the terminals of the battery by an elongated flexible strap so that the socket connector can remain with the battery after battery installation.

2. Brief Description of the Prior Art

In the past,. it has been the conventional practice to employ storage batteries for supplying power to various electronic circuits, components and equipment, motorcycles, boats, recreational vehicles or the like. In these situations, the battery may not be used for long periods of time so that the charge greatly diminishes and when the operator desires to use the vehicle, the battery is dead or it does not have sufficient energy to perform the electrical functions. In this instance, a battery charger is then employed to recharge the battery. This requires a time-consuming procedure and the operator is delayed in using his vehicle.

In some instances, tricklechargers are attached to the battery when the vehicle is not in operation so that a slow charge is provided to the battery whereby the battery is ready for use when the operator desires even after a long period of vehicle non-use. In connection with the use of trickle chargers, care must be taken that the charge not be overdone or the battery may explode. Also, great care must be taken when placing the terminals of the trickle charger with the terminals of the battery so that the polarization is matched. A mismatch will also cause an explosion and great damage to life and limb as well as property.

Therefore, a long-standing need has existed to provide a socket connector for receiving the plug of a charger whereby a mismatch of polarity is avoided and the socket connector is available for use in situ without the necessity of having to remove the socket connector at the conclusion of the charging procedure.

SUMMARY OF THE INVENTION

Accordingly, the above problems and difficulties are avoided by the present invention which provides a flex cabling having a socket connector at one end and a pair of terminal caps at the other end. The flex cabling constitutes a flexible member such as plastic or the like into which a run of flat conductor material or wire is embedded extending from a pair of polarized terminals in the socket connector to the respective terminal caps. The flex cabling including the terminal caps and the socket connector form a one-piece unitary construction and the terminal caps are adapted to be placed over and to insertably receive terminals on the battery. The terminals of the socket connector are marked with positive and negative indicia so that a mismatch of polarity from the plug of the battery charger cannot be misaligned. Misalignment is further avoided by providing a keyway in the socket connector so that the connectors of the plug from the charger can only be inserted into the terminals of the socket connector in proper orientation. The socket connector further includes a panel which may be pivotally or slidably carried adjacent to the terminals so that the terminals may be covered to prevent dirt, debris or any foreign matter from entering into the socket.

Therefore, it is among the primary objects of the present invention to provide a novel socket connector for interconnecting the plug of a charger with the terminals of a battery so that misalignment of polarity cannot be experienced and which further provides a flexible cable interconnecting the terminals of the socket with the terminals of the battery.

Another object of the present invention is to provide a novel interconnecting means between the connectors of a battery charger plug and the sockets in a connector so that misalignment of polarity cannot be experienced.

A further object resides in providing a flex cabling polarity socket connector which is detachably connected to the terminals of the battery by means of caps which insertably receive the terminals.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF PREFERRED EMBODIMENT

Figure 1:
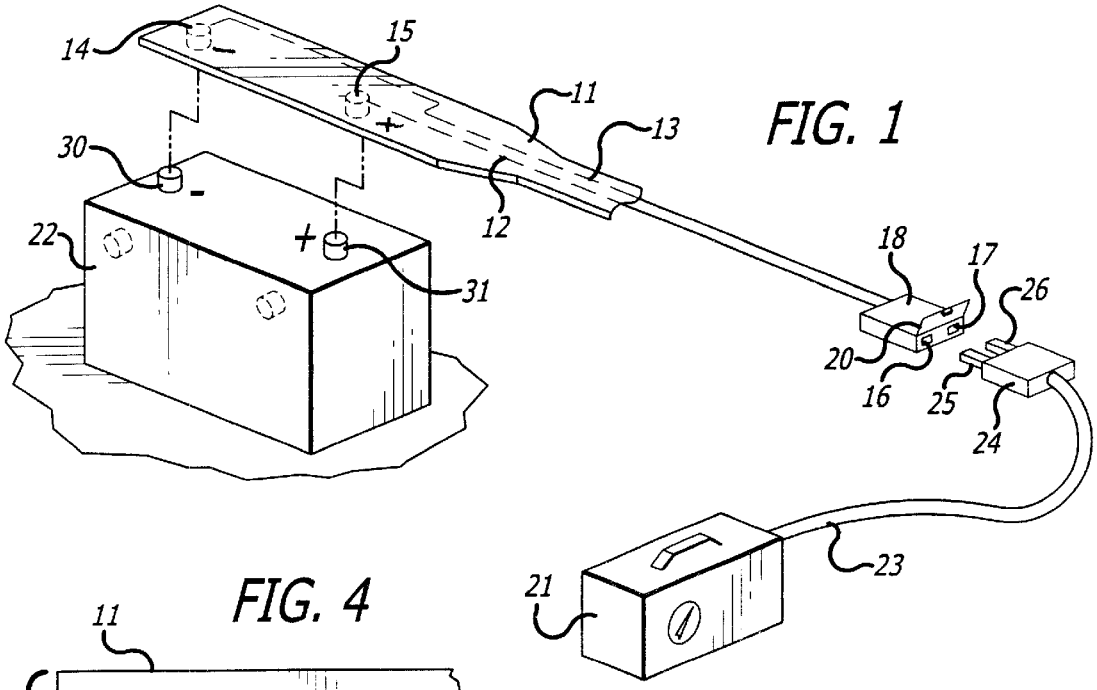
FIG. 1 is a perspective view of the novel charger-to-battery connector incorporating the present invention.
Figure 4:
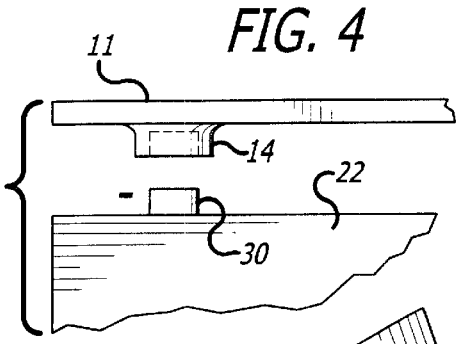
FIG. 4 is a view of a snap-on-terminal.

Referring to FIG. 1, the novel flex cable connector of the present invention is illustrated in the general direction of arrow 10 which includes an elongated flexible cable 11 composed of a flexible or deformable plastic material into which a pair of wires or runs of flat connectors are embedded. Once such run of a flat connector is indicated by numeral 12 while the other is indicated by numeral 13. The ends of the flat connectors 12 and 13 are connected to terminal caps 14 and 15 while the opposite ends of the flat connectors are connected to terminals 16 and 17 carried by a socket connector 18. A panel 20 is pivotally or slidably carried on the front face of the housing for the socket connector 18 in such a manner as to selectively cover the openings into the socket terminals 16 and 17 to prevent debris, dirt or other foreign matter from entering into the sockets when not in use.

The flexible cable connector 10 is intended to couple a battery charger such as a trickle charger 21 with a conventional battery 22. The trickle charger 21 includes a cord 23 which terminates in a plug 24 having connectors 25 and 26 which are intended to be inserted into the circuit terminals 17 and 17. The caps 14 and 15 are intended to be placed over and to be pressed into engagement with terminals 30 and 31 of the battery 22. The terminals may be located on top of the battery or one the side of the battery as is the conventional practice. The terminals 30 and 31 outwardly project from the battery case and are insertably received within the receptacles of the caps 14 and is respectively.

It is particularly to be noted that the terminals 30 and 31 have a positive and negative polarity and that the caps 14 and 15 are staggered in fixed, spaced-apart relationship so that caps 14 and 15 can only be placed on their respective terminals 30 and 31. thus, the terminals, caps and the wiring 12 and 13 are connected to different polarities and the terminal sockets 16 and 17 are of opposite and different polarities. Therefore, the connectors 25 and 26 of the charger plug 24 must be properly inserted into the proper sockets in order to prevent damage,,explosion or injury to the user.

Figure 2:
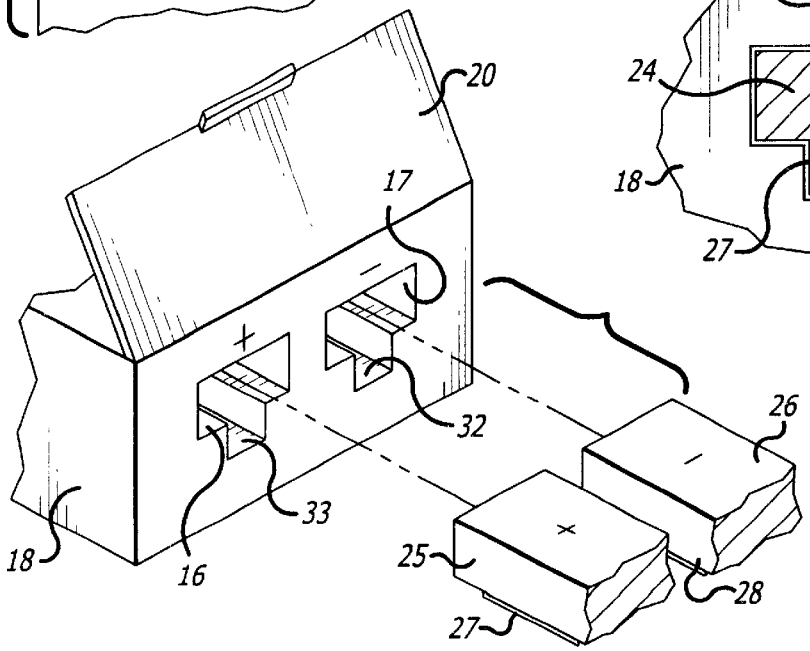
FIG. 2 is a fragmentary perspective view showing the keying system for aligning the connectors of the plug with the sockets of the socket connector to prevent misalignment.

Referring now in detail to FIG. 2, it can be seen that the socket terminals 16 and 17 are configured to include a keyway such as indicated by grooves 32 and 33 respectively. For example, socket terminal 17 may be of negative polarity while socket 16 is of positive polarity. It is also to be noted that the mating plug connectors 25 and 26 are also of a specified polarity such that connector 26 will mate with the socket 17 and connector 25 will mate with socket 16. Proper mating is assured by means of projections 27 and 28 carried on the underside of each of the plug connectors 25 and 26 and these projections are intended to be received within the slots or grooves 32 and 33 simultaneously when the plug 24 is mated with the socket connector 18. In this manner, the mismatch of polarity cannot be achieved. The panel 20, although illustrated in a folded back position, can either be hinged to the housing of the socket connector 18 or a sliding panel can be arranged.

Figure 3:
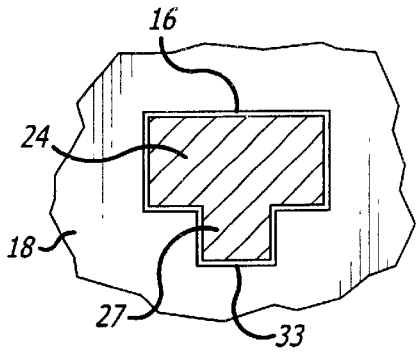
FIG. 3 is an enlarged fragmentary view, in section, illustrating the connection between a plug connector and the socket connector incorporating the key arrangement of the present invention.

Referring now in detail to FIG. 3, it can be seen that the projection 27 has been insertably received within the slot 33 of the terminal 16. A similar relationship is effected by insertion of connector 26 into terminal 17. It is to be understood that the shape of projection 27 must match the shape or groove of slot 33 in order to accept insertion. The shape may take the form of a star, a crescent or any other geometric configuration so as to represented a coded keyway.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A charger-to-battery connecting cable comprising:

an elongated connecting flat flex cable composed of a pliable and flexible composition and having a pair of integral opposite ends terminating a length of said connecting flat cable;

said flat cable having a width greater than its thickness;

a selected end of said pair of integral opposite ends having a socket connector and the other end having caps;

said socket connector provided with a pair of electrical connectors with openings leading into said socket connector;

a pair of flat electrical conductors embedded in said length of connecting cable arranged in parallel fixed, spaced-apart relationship extending between and terminating with said caps and said socket electric connectors respectively;

said caps and said socket electrical connectors identified with visual polarity indicia wherein selected ones of said caps and said socket electrical connectors are connected together in matching polarity indicia;

said caps are snap-on terminal connectors;

a gravity deployable and movable panel hingeably carried on said socket connector as a unitary construction for selectively covering said openings;

said openings are configured with a particular and critical geometry representing a coded pattern keyed with and cooperating with said visual polarity indicia to be indexed with and registered with an identically coded pattern disposed on a battery charger plug;

said caps include snap-lock sockets detachably connectable with a pair of battery terminals outwardly projecting from a battery;

said length of said connecting flat cable includes a first section and a second section;

said socket connector disposed on said first section and said caps disposed on said second section;

said first section having a width narrower than a width of said second section; and said elongated connecting flat cable, including said flat conductors, constitutes a flex cable having full bending and flexing characteristics.

* * * * *